US005582191A

United States Patent [19]

Sartoni et al.

[11] Patent Number: 5,582,191

[45] Date of Patent: Dec. 10, 1996

[54] METHOD AND MACHINE FOR SIMULTANEOUSLY PRODUCING TWO CONTINUOUS CIGARETTE RODS

[75] Inventors: Massimo Sartoni, Bologna; Fiorenzo Draghetti, Medicina, both of Italy

[73] Assignee: G. D Societa' Per Azioni, Bologna, Italy

[21] Appl. No.: 498,091

[22] Filed: Jul. 5, 1995

[30] Foreign Application Priority Data

Jul. 13, 1994 [IT] Italy ..... B094A0328

[51] Int. Cl.[6] ..... A24C 5/18

[52] U.S. Cl. ..... 131/84.1; 131/108; 198/689.1

[58] Field of Search ..... 131/84.1–84.4, 131/108; 198/348, 362, 445, 689.1

[56] References Cited

U.S. PATENT DOCUMENTS 5,199,446 4/1993 Cahill et al. ..... 131/84.1

5,413,121 5/1995 Dawson et al. ..... 131/84.1

FOREIGN PATENT DOCUMENTS 2130869 6/1984 United Kingdom .

2141318 12/1984 United Kingdom .

2224631 5/1990 United Kingdom .

2226226 6/1990 United Kingdom .

*Primary Examiner*—Jennifer Bahr

*Attorney, Agent, or Firm*—Marshall, O'Toole, Gerstein, Murray & Borun

[57] ABSTRACT

A method and machine whereby a stream of shredded tobacco is fed through a dividing device for dividing the stream into two substreams and feeding the two separate substreams to a forming device downstream from the dividing device; the dividing device presenting two suction belts in turn presenting respective dividing branches crosswise to the stream, and each of which belts provides for retaining a respective portion of the stream by suction to form a respective substream.

13 Claims, 3 Drawing Sheets

METHOD AND MACHINE FOR SIMULTANEOUSLY PRODUCING TWO CONTINUOUS CIGARETTE RODS

BACKGROUND OF THE INVENTION

The present invention relates to a method of simultaneously producing two continuous cigarette rods.

On dual-rod cigarette manufacturing machines, a stream of shredded tobacco is fed to the bottom end of an upflow duct closed at the top by two side by side suction belts; is blown along the upflow duct; and is divided in various ways into two equal parts, which are deposited respectively on to the suction belts to form, on the belts, respective beads of tobacco, which are shaved by means of shaving devices, and fed by the belts on to respective strips of paper traveling through a cigarette rod forming beam.

Though used on most known dual-rod cigarette manufacturing machines, the above method presents several possible drawbacks, due to the upflow duct invariably determining the geometry of the machine as a whole, which is not always satisfactory in terms of maintenance and safety.

SUMMARY OF THE INVENTION

It is an object of the present invention to provide a straightforward, relatively low-cost method of simultaneously producing two continuous cigarette rods with no need for a dividing upflow duct.

According to the present invention, there is provided a method of simultaneously producing two continuous cigarette rods, the method comprising the steps of feeding a stream of shredded tobacco in a given traveling direction to a dividing device; dividing the stream into two substreams inside the dividing device; and feeding the two separate substreams to a rod forming device downstream from the dividing device; characterized in that said stream is divided into two substreams by intercepting it via two suction belts presenting respective dividing branches crosswise to the stream and converging with each other; and by retaining respective portions of the stream on said belts by suction, to form, on the belts, respective layers of tobacco; each said layer defining a respective said substream; and the two substreams being fed to the forming device along separate respective paths.

According to a preferred embodiment of the above method, each substream is fed to the forming device on a respective strip of paper material, to form a respective bead of tobacco of a respective cigarette rod.

The present invention also relates to a machine for simultaneously producing two continuous cigarette rods.

According to the present invention, there is provided a machine for simultaneously producing two continuous cigarette rods, the machine comprising conveyor means for feeding a stream of shredded tobacco in a given traveling direction; a forming device for forming two continuous cigarette rods; and a dividing device interposed between said conveyor means and said forming device, and which provides for dividing said stream into two substreams, and feeding the separate substreams to the forming device; characterized in that said dividing device comprises two suction belts presenting respective dividing branches crosswise to said stream and converging with each other, and respective supply branches interposed between the dividing branches and the forming device; each dividing branch retaining a respective portion of said stream by suction, to form a respective layer of tobacco defining a respective said substream; and each supply branch feeding the respective substream to the forming device.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
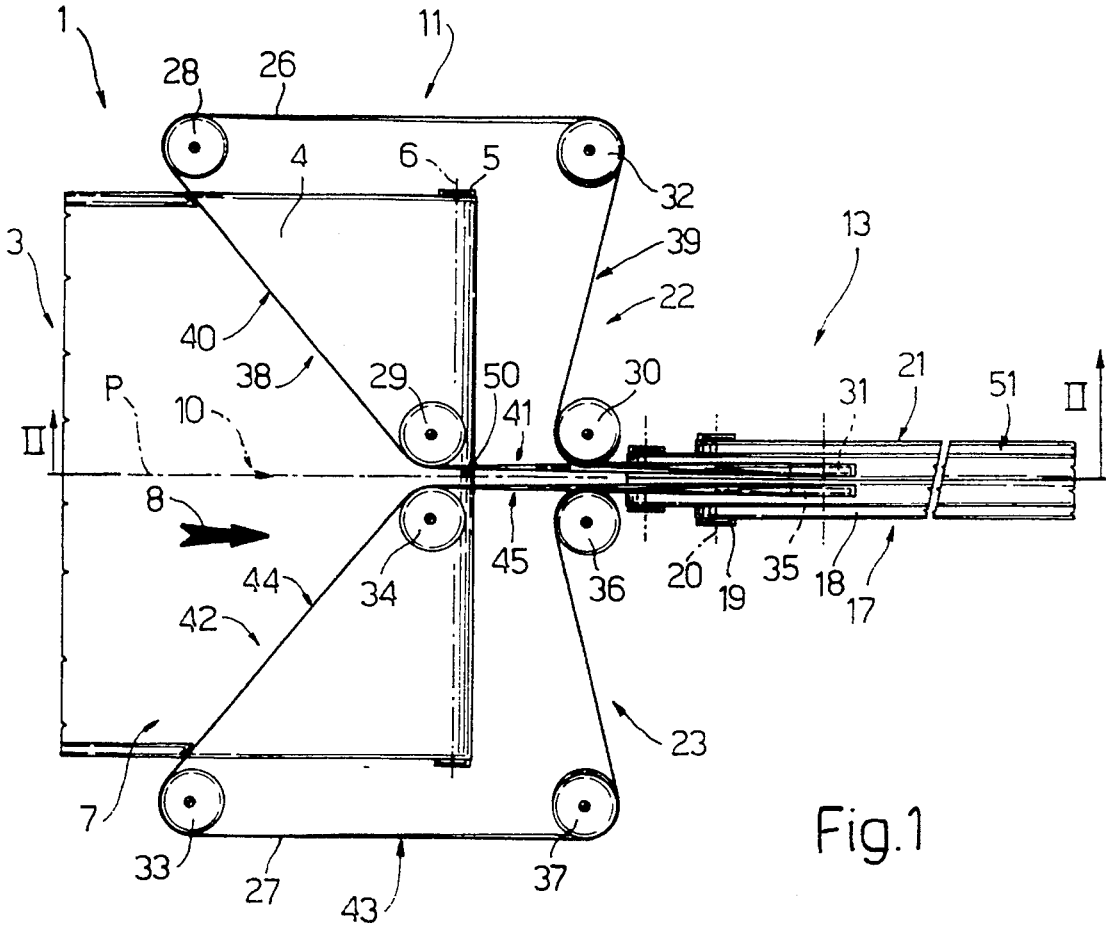
FIG. 1 shows a schematic plan view of a preferred embodiment of the machine according to the present invention.
Figure 2:
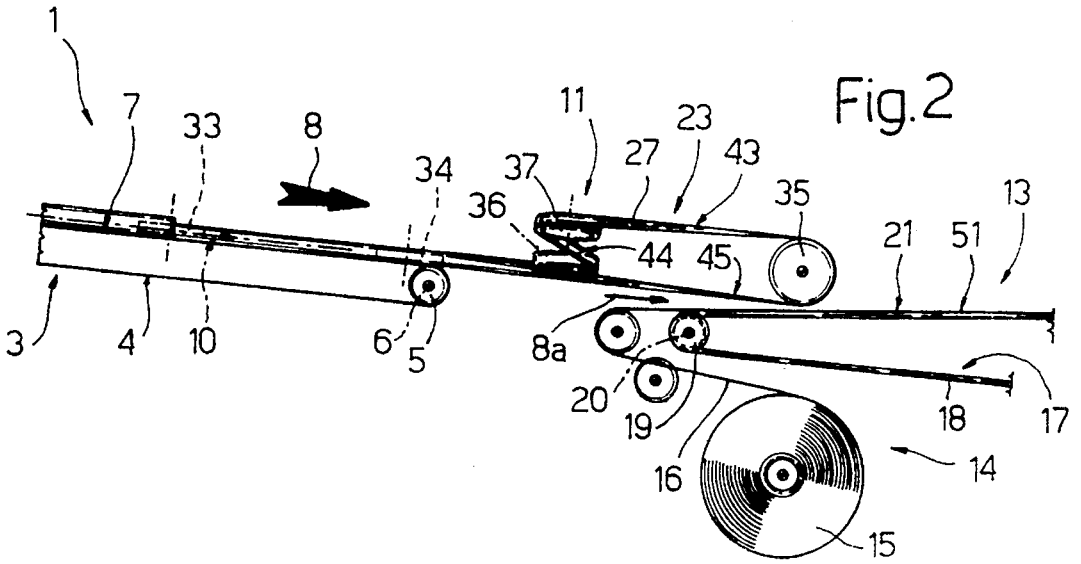
FIG. 2 shows a section along line II II in FIG. 1.
Figure 4:
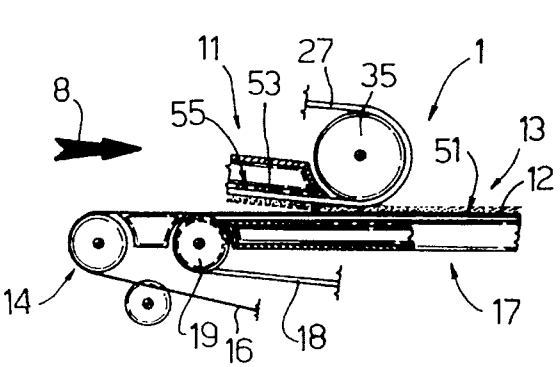
FIG. 4 shows a larger-scale view of a detail in FIG. 2.
Figure 3:
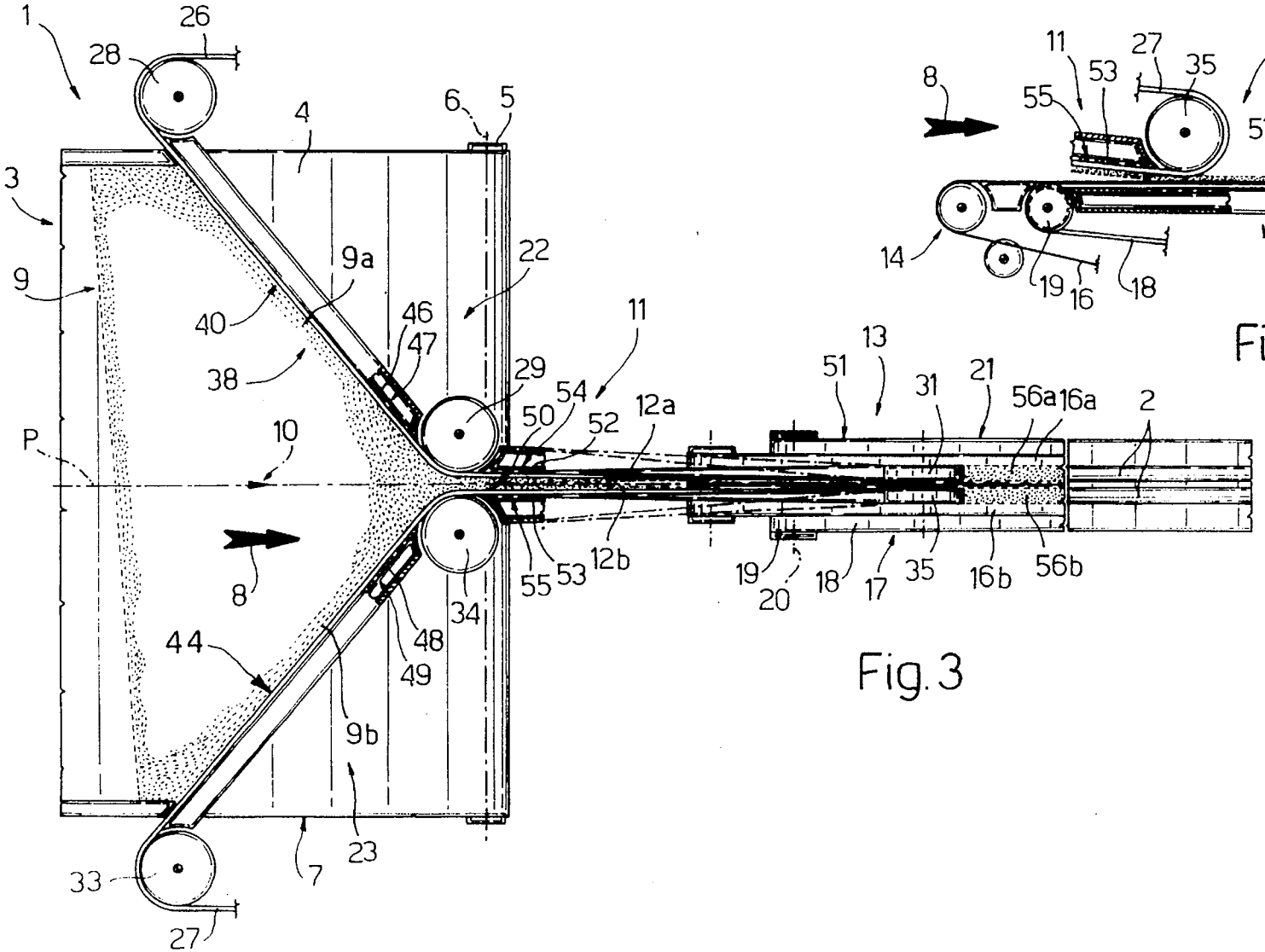
FIG. 3 shows a larger-scale plan view, with parts in section and parts removed for clarity, of a detail in FIG. 1.

Number 1 in FIGS. 1 and 3 indicates a machine for simultaneously producing two continuous cigarette rods 2.

Machine 1 comprises a conveyor belt 3 presenting a belt 4 of permeable material looped about two pulleys 5 (only one shown) rotating clockwise (in FIGS. 1 and 3) about respective horizontal axes 6, and defining, on belt 4, a transportation branch 7 traveling in an almost horizontal but slightly downward-sloping direction 8, to feed a stream 9 of shredded tobacco along the initial portion of a path 10.

Machine 1 also comprises a dividing device 11 located downstream from conveyor 3, substantially in direction 8, and which provides for dividing stream 9 into two substantially identical substreams 12 of shredded tobacco; a forming device 13 downstream from device 11 along path 10; and a known unwinding and cutting device 14 for a reel 15 of continuous paper strip 16.

Forming device 13 is fed through with strip 16 divided in known manner by device 14 into two strips indicated **16*a* and 16*b* in FIG. 3; and comprises a conveyor belt 17 presenting a belt 18 of permeable material looped about two pulleys 19 (only one shown) rotating about respective horizontal axes 20 parallel to axes 6. Pulleys 19 define, on belt 18, a substantially horizontal transportation branch 21 substantially parallel to direction 8, and which provides for feeding strips 16*a* and 16*b* to the output portion of path 10, each strip 16*a*, 16*b* having been loaded, in use, by dividing device 11 with a respective substream 12 indicated 12*a*, 12*b*** for the sake of clarity.

Figure 5:
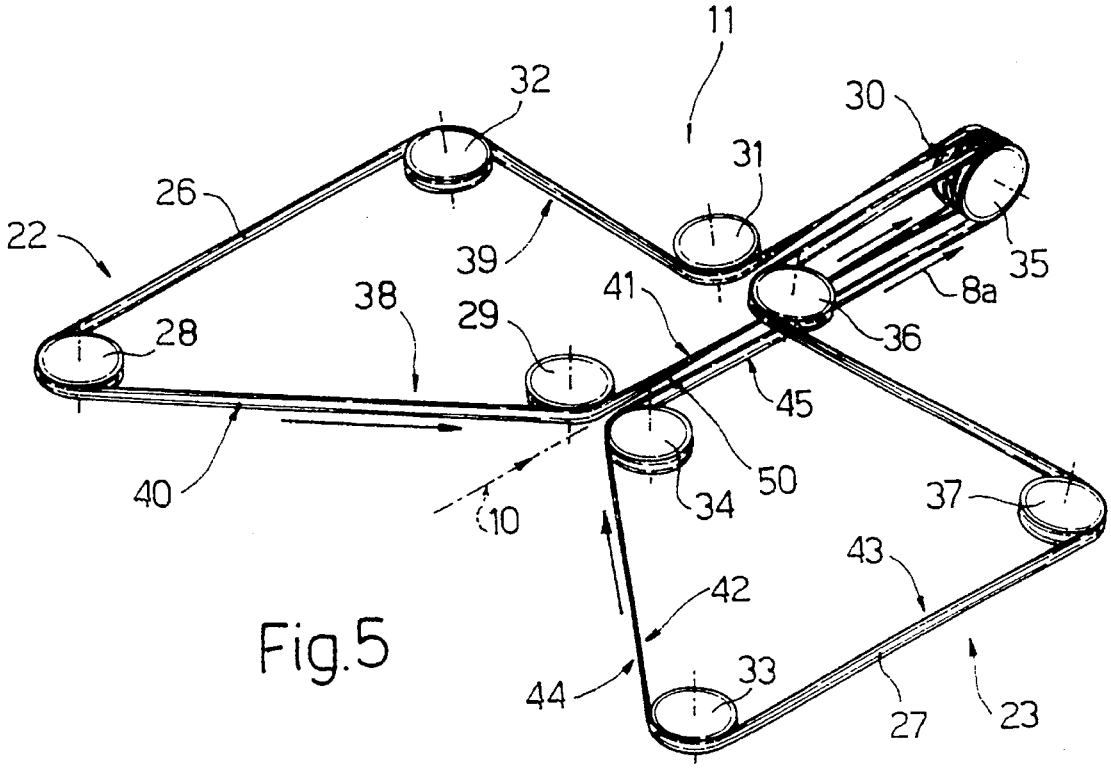
FIGS. 5 and 6 show two schematic views in perspective of a detail in FIG. 1.
Figure 6:
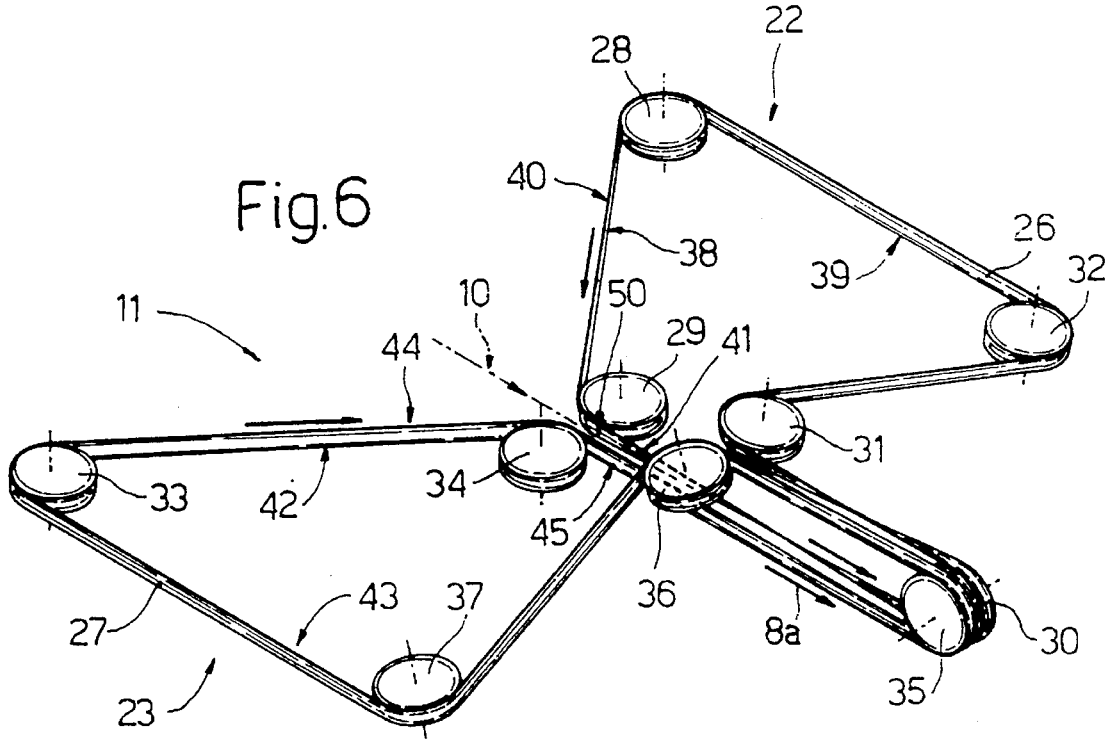

As shown more clearly in FIGS. 5 and 6, dividing device 11 comprises two conveyors 22 and 23 arranged symmetrically in relation to a plane P parallel to direction 8 and constituting the plane of symmetry of belt 4 of conveyor 3.

Conveyors 22 and 23 are defined by respective belts 26 and 27 looped about a number of pulleys indicated 28–32 for conveyor 22, and 33–37 for conveyor 23. Pulleys 28, 29 of conveyor 22 and pulleys 33, 34 of conveyor 23 rotate about respective axes parallel to one another and perpendicular to branch 7 of conveyor 3; pulleys 31, 32 of conveyor 22 rotate about respective axes parallel to each other and inclined in relation to the axes of pulleys 28, 29; pulleys 36, 37 of conveyor 23 rotate about respective axes parallel to each other and inclined in relation to the axes of pulleys 33, 34 and in the opposite direction to the axes of pulleys 31, 32; and pulley 30 of conveyor 22 and pulley 35 of conveyor 23 are arranged coaxially side by side, so as to rotate about a common axis crosswise to direction 8 and to the axes of pulleys 29, 34.

Pulleys 28, 30 of conveyor 22 are end pulleys defining, on belt 26, a forward branch 38 and a return branch 39; which branch 38 comprises a dividing or pickup branch 40 extending between pulleys 28 and 29, and a supply or output branch 41 extending between pulleys 29 and 30 in a supply direction 8*a* substantially parallel to direction 8. Similarly, pulleys 33, 35 of conveyor 23 are end pulleys defining, on belt 27, a forward branch 42 and a return branch 43; which branch 42 comprises a dividing or pickup branch 44 extending between pulleys 33 and 34, and a supply or output branch 45 extending between pulleys 34 and 35 in supply direction 8*a*.

As shown in FIG. 3, branch 40 of belt 26 lies in a plane perpendicular to the plane of branch 7; extends entirely on the same side of the plane of symmetry P of branch 7, and over branch 7 in a direction substantially crosswise to direction 8; is so positioned as to slide over a respective half of branch 7; and is supported on a perforated plate 46 forming a lateral wall of a suction box 47. Box 47 is mounted between pulleys 28 and 29, and presents an outlet conduit (not shown) communicating with a known suction device (not shown) for retaining a given portion—in this case, half—of stream 9 by suction, and forming a substream 12*a* of shredded tobacco on branch 40. Similarly, branch 44 of belt 27 lies in a plane perpendicular to the plane of branch 7; extends entirely on the opposite side to branch 40 of the plane of symmetry P of branch 7, and over branch 7 in a direction substantially crosswise to direction 8; is so positioned as to slide over a respective half of branch 7; and is supported on a perforated plate 48 forming a lateral wall of a suction box 49. Box 49 is mounted between pulleys 33 and 34, and presents an outlet conduit (not shown) communicating with a known suction device (not shown) for retaining a given portion—in this case, half—of stream 9 by suction, and forming a substream 12*b* of shredded tobacco on branch 44.

Dividing branches 40 and 44 converge with each other, and are inclined slightly in direction 8 towards pulleys 29 and 34 to define the tapered input portion of a channel 50 extending in direction 8 towards forming device 13 and defined laterally by supply branches 41 and 45; and, as the axes of pulleys 29 and 34 are perpendicular to the common axis of respective pulleys 30 and 35, branches 41 and 45 twist by an angle of 90° about respective axes (not shown) parallel to each other and to direction 8*a*. Consequently, like branches 40 and 44, the input portion of branches 41 and 45 lies in a plane perpendicular to that of branch 7 of conveyor 3, while the output portion of branches 41 and 45 lies in a plane tangent to the periphery of respective pulley 30, 35 and directly facing the upper surface 51 of transportation branch 21 of belt 18.

Each branch 41, 45 is also located contacting a helical perforated plate 52, 53 forming a lateral wall of a suction box 54, 55 mounted between pulleys 29–30, 34–35, and presenting an outlet conduit (not shown) communicating with a known suction device (not shown) for retaining substream 12*a*, 12*b* on the outer surface of branch 41, 45 by suction.

In actual use, each half of stream 9 on each side of plane P is intercepted by dividing branch 40, 44 of belt 26, 27 so as to gradually form, on branch 40, 44, a layer 9*a*, 9*b*, which, when fully formed at pulley 29, 34, defines substream 12*a*, 12*b*; and substream 12*a*, 12*b* is then fed by branch 41, 45 in direction 8*a* and along channel 50 to forming device 13 where it is unloaded on to strip 16*a*, 16*b* to form, on strip 16*a*, 16*b*, a bead 56*a*, 56*b* of shredded tobacco constituting the content of a respective continuous rod 2.

As opposed to vertically extending portions, machine 1 as described above therefore substantially comprises portions extending substantially horizontally and parallel to direction 8.

We claim:

1. A method of simultaneously producing two continuous cigarette rods (2), the method comprising the steps of feeding a stream (9) of shredded tobacco in a given traveling direction (8) to a dividing device (11); dividing the stream (9) into two substreams (12*a*, 12*b*) inside the dividing device (11); and feeding the two separate substreams (12*a*, 12*b*) to a rod forming device (13) downstream from the dividing device (11); characterized in that said stream (9) is divided into two substreams (12*a*, 12*b*) by intercepting it via two suction belts (26, 27) presenting respective dividing branches (40, 44) crosswise to the stream (9) and converging with each other; and by retaining respective portions of the stream (9) on said belts (26, 27) by suction, to form, on the belts (26, 27), respective layers (9*a*, 9*b*) of tobacco; each said layer (9*a*) (9*b*) defining a respective said substream (12*a*)(12*b*); and the two substreams (12*a*, 12*b*) being fed to the forming device (13) along separate respective paths.

2. A method as claimed in claim 1, characterized in that each said substream (12*a*) (12*b*) is fed to the forming device (13) on a respective strip (16*a*) (16*b*) of paper material, to form a respective bead (56*a*) (56*b*) of tobacco of a respective cigarette rod (2).

3. A method as claimed in claim 1, characterized in that each substream (12*a*) (12*b*) is fed to the forming device (13) in a supply direction (8*a*) substantially parallel to said traveling direction (8).

4. A method as claimed in claim 3, characterized in that each substream (12*a*) (12*b*) is fed to the forming device (13) via a respective said belt (26) (27) which defines a respective supply branch (41) (45) parallel to and traveling in said supply direction (8*a*) to the forming device (13).

5. A method as claimed in claim 3, wherein the forming device (13) includes a transportation surface (51), and characterized in that, as it travels in said supply direction (8*a*), each said layer (9*a*) (9*b*) is fed along a cylindrical helix by rotating substantially 90° about an axis parallel to the supply direction (8*a*), and between a plane crosswise to and a plane substantially parallel to the transportation surface (51) of the forming device (13).

6. A machine for simultaneously producing two continuous cigarette rods (2), the machine comprising conveyor means (3) for feeding a stream (9) of shredded tobacco in a given traveling direction (8); a forming device (13) for forming two continuous cigarette rods (2); and a dividing device (11) interposed between said conveyor means (3) and said forming device (13), and which provides for dividing said stream (9) into two substreams (12*a*, 12*b*), and feeding the separate substreams (12*a*, 12*b*) to the forming device (13); characterized in that said dividing device (11) comprises two suction belts (26, 27) presenting respective dividing branches (40, 44) crosswise to said stream (9) and converging with each other, and respective supply branches (41, 45) interposed between the dividing branches (40, 44) and the forming device (13); each dividing branch (40) (44) retaining a respective portion of said stream (9) by suction, to form a respective layer (9*a*) (9*b*) of tobacco defining a respective said substream (12*a*) (12*b*); and each supply branch (41) (45) feeding the respective substream (12*a*) (12*b*) to the forming device (13).

7. A machine as claimed in claim 6, characterized in that each said supply branch (41) (45) extends in a supply direction (8*a*) substantially parallel to said traveling direction (8).

8. A machine as claimed in claim 7, characterized in that said conveyor means (3) define a first transportation surface (7) for said stream (9); and the forming device (13) defines a second transportation surface (51) for said substreams (12*a*, 12*b*); said two transportation surfaces (7, 51) being substantially parallel to each other; and each dividing branch (40) (44) lying in a plane crosswise to the first transportation surface (7).

9. A machine as claimed in claim 8, characterized in that each said supply branch (41) (45) twists substantially 90° in the form of a cylindrical helix extending in the supply direction (8*a*), and comprises an input portion and an output portion lying in respective planes respectively substantially crosswise to and substantially parallel to said second transportation surface (51).

10. A machine as claimed in claim 9, characterized in that each said output portion is substantially tangent to said second transportation surface (51).

11. A machine as claimed in claim 8, characterized in that said two belts (26, 27) are endless belts looped about respective numbers of pulleys (28–32) (33–37); a first pulley (30) (35) in each said number of pulleys (28–32) (33–37) presenting a first axis parallel to said second transportation surface (51), and being positioned with its periphery substantially tangent to said second transportation surface (51).

12. A machine as claimed in claim 11, characterized in that each said number of pulleys (28–32) (33–37) comprises at least two second pulleys (28, 29) (33, 34) with their axes perpendicular to said first axis; said two second pulleys (28, 29) (33, 34) defining the opposite ends of said dividing branch (40) (44).

13. A machine as claimed in claim 12, characterized in that each said first pulley (30) (35) and one (29) (34) of the relative two second pulleys (28, 29) (33, 34) define the opposite ends of the relative said supply branch (41) (45).

* * * * *